US009228700B2

(12) United States Patent
Westermarck et al.

(10) Patent No.: US 9,228,700 B2
(45) Date of Patent: Jan. 5, 2016

(54) LED LIGHT TUBE AND REPLACEMENT METHOD

(71) Applicants: Joel C. Westermarck, Lauderhill, FL (US); Paul Kenny, Hong Kong (HK)

(72) Inventors: Joel C. Westermarck, Lauderhill, FL (US); Paul Kenny, Hong Kong (HK)

(73) Assignee: LEDS America, Inc., Lauderhill, FL (US)

( * ) Notice: Subject to any disclaimer, the term of this patent is extended or adjusted under 35 U.S.C. 154(b) by 0 days.

(21) Appl. No.: 14/489,643

(22) Filed: Sep. 18, 2014

(65) Prior Publication Data

US 2015/0003052 A1 Jan. 1, 2015

Related U.S. Application Data

(63) Continuation of application No. 13/164,406, filed on Jun. 20, 2011, now abandoned.

(60) Provisional application No. 61/471,109, filed on Apr. 2, 2011, provisional application No. 61/356,754, filed on Jun. 21, 2010.

(51) Int. Cl.

| | |
|---|---|
| ***F21V 21/005*** | (2006.01) |
| ***F21K 99/00*** | (2010.01) |
| ***F21V 29/00*** | (2015.01) |
| ***F21V 29/74*** | (2015.01) |
| *F21V 23/02* | (2006.01) |
| *F21Y 101/02* | (2006.01) |

(Continued)

(52) U.S. Cl.

CPC . *F21K 9/175* (2013.01); *F21K 9/17* (2013.01); *F21K 9/90* (2013.01); *F21V 21/005* (2013.01); *F21V 29/2212* (2013.01); *F21V 29/74* (2015.01); *F21V 23/023* (2013.01); *F21Y 2101/02* (2013.01); *F21Y 2103/003* (2013.01); *F21Y 2105/003* (2013.01); *Y10T 29/49117* (2015.01)

(58) Field of Classification Search

CPC ..... F21Y 2103/003; F21Y 2103/20; F21Y 2103/00; F21Y 2111/005; F21Y 2111/008

USPC ..... 315/51, 185 R, 246, 291, 294; 362/218, 362/221, 223, 225, 217.1, 240, 249.02, 800

See application file for complete search history.

(56) References Cited

U.S. PATENT DOCUMENTS

| | | | |
|---|---|---|---|
| D246,330 | S | 11/1977 | Krase et al. |
| D255,851 | S | 7/1980 | Crane |

(Continued)

OTHER PUBLICATIONS

LED Dynamics Brochure EverLed, Apr. 2010.

(Continued)

*Primary Examiner* — Thai Pham

(74) *Attorney, Agent, or Firm* — Robert C. Kain, Jr.

(57) ABSTRACT

LED light tube replaces a fluorescent light mounted in a fluorescent light fixture. Main power is feed only to the first socket end mount of the fluorescent fixture. The LED light tube includes an elongated tubular structure substantially the size and length of the fluorescent light tube and extends between the first and second end mounts of the fixture. Within an end region of the tubular structure and adjacent the first tube end mount, an internal power supply converts the main line power to LED bank power. The tubular structure of the LED light includes an elongated semi-spherical substantially transparent top cover mounted atop a printed circuit board substrate. The substrate supports a plurality of LEDs thereon.

27 Claims, 9 Drawing Sheets

(51) Int. Cl.
*F21Y 105/00* (2006.01)
*F21Y 103/00* (2006.01)

(56) References Cited

U.S. PATENT DOCUMENTS

D255,941 S 7/1980 Grant
D259,586 S 6/1981 Johnson
D260,187 S 8/1981 Andersson
D261,056 S 9/1981 Andersson
D266,578 S 10/1982 Moshier
D268,367 S 3/1983 Paquette et al.
D274,657 S 7/1984 Herst et al.
D284,110 S 6/1986 Mullins
D285,977 S 9/1986 De Pas et al.
D286,206 S 10/1986 Joosten et al.
D291,928 S 9/1987 Morten
D294,067 S 2/1988 Ambasz
D295,086 S 4/1988 Morten
D300,471 S 3/1989 Szymanek
D300,874 S 4/1989 Szymanek
D304,507 S 11/1989 Evenson
D304,862 S 11/1989 DiCola
D306,772 S 3/1990 De'Armond
D307,059 S 4/1990 Szymanek
D311,596 S 10/1990 Herst et al.
D311,967 S 11/1990 Herst et al.
D318,534 S 7/1991 Deursen et al.
D318,929 S 8/1991 Herst et al.
D319,513 S 8/1991 Vande Kieft
D321,407 S 11/1991 Heidmann
D321,409 S 11/1991 Bischof et al.
D329,104 S 9/1992 Dieperink
D329,715 S 9/1992 Dieperink
D330,090 S 10/1992 Walter et al.
D330,268 S 10/1992 Jaksich
D330,269 S 10/1992 Hong
D330,438 S 10/1992 Herst et al.
D331,119 S 11/1992 Hagebo
D331,292 S 11/1992 Ham
D332,836 S 1/1993 Ham
D333,530 S 2/1993 Boundy
D334,821 S 4/1993 Morgan
D335,191 S 4/1993 Morgan
D336,352 S 6/1993 Dieperink et al.
D337,844 S 7/1993 Poirier
D337,845 S 7/1993 Belic
D338,980 S 8/1993 Dieperink
D341,439 S 11/1993 Herst et al.
D342,799 S 12/1993 Ham
D344,605 S 2/1994 Aspenwall
D347,703 S 6/1994 Ham
D348,533 S 7/1994 Herst et al.
D348,534 S 7/1994 Herst et al.
D348,946 S 7/1994 Watters et al.
D348,947 S 7/1994 Holcomb
D348,950 S 7/1994 Herst et al.
D349,357 S 8/1994 Herst et al.
D349,358 S 8/1994 Herst et al.
D351,481 S 10/1994 Cole, Jr.
D351,482 S 10/1994 Johnson et al.
D352,566 S 11/1994 Johnson et al.
D357,088 S 4/1995 Grooms et al.
D359,575 S 6/1995 How et al.
D362,315 S 9/1995 Herst et al.
D363,805 S 10/1995 Cole, Jr.
D364,478 S 11/1995 Pesau
D369,426 S 4/1996 Sonneman
D371,858 S 7/1996 Waldmann
D374,301 S 10/1996 Kleffman
D377,993 S 2/1997 Herst et al.
D379,099 S 5/1997 Strandberg et al.
D381,760 S 7/1997 Costa
D384,178 S 9/1997 Costa
D384,764 S 10/1997 Littman
D385,379 S 10/1997 Tillotson
D386,278 S 11/1997 Engle et al.
D387,462 S 12/1997 Huang
D389,940 S 1/1998 Waldmann
D393,734 S 4/1998 Casteel
D395,727 S 6/1998 Thorton, Jr.
D396,122 S 7/1998 Noh
D397,479 S 8/1998 Compton et al.
D397,481 S 8/1998 Schafer
D397,485 S 8/1998 Kalthoff
D397,818 S 9/1998 Herst et al.
D398,413 S 9/1998 Compton
D399,329 S 10/1998 Compton et al.
D399,587 S 10/1998 Compton et al.
D399,588 S 10/1998 St. Ives
D401,000 S 11/1998 Herst
D403,097 S 12/1998 Littman
D404,160 S 1/1999 Herst et al.
D404,161 S 1/1999 Herst et al.
D405,906 S 2/1999 Herst et al.
D405,907 S 2/1999 Herst et al.
D405,908 S 2/1999 Herst et al.
D407,473 S 3/1999 Wimbock
D412,999 S 8/1999 Herst et al.
D413,998 S 9/1999 Littman
D414,287 S 9/1999 Sapper
D414,580 S 9/1999 Herst
D415,304 S 10/1999 Brown
D418,936 S 1/2000 Dunning
D421,146 S 2/2000 Poulton
D421,505 S 3/2000 Hastings et al.
D421,815 S 3/2000 Herst et al.
D421,816 S 3/2000 Canton Gongora et al.
D424,230 S 5/2000 Noh
D424,732 S 5/2000 Cece
D427,706 S 7/2000 Irvine
D428,508 S 7/2000 Irvine
D429,357 S 8/2000 Grimm
D430,688 S 9/2000 Plunk
D431,086 S 9/2000 Cole, Jr.
D431,876 S 10/2000 Lewis
D432,255 S 10/2000 Fahmian
D432,696 S 10/2000 Ford
D432,697 S 10/2000 Fahmian
D433,524 S 11/2000 Szymanek
D434,167 S 11/2000 Foster
D434,175 S 11/2000 Fahmian
D434,519 S 11/2000 Herst et al.
D435,310 S 12/2000 Herst et al.
D437,959 S 2/2001 Lewis
D438,326 S 2/2001 Kan
D439,349 S 3/2001 Fahmian
D440,340 S 4/2001 Tillman et al.
D441,117 S 4/2001 Grimm
D441,890 S 5/2001 Grimm
D441,891 S 5/2001 Herst et al.
D442,722 S 5/2001 Fahmian
D443,095 S 5/2001 McMahon
D443,096 S 5/2001 Echito
D444,262 S 6/2001 Eberlein et al.
D444,587 S 7/2001 Hastings et al.
D445,211 S 7/2001 Baker
D445,214 S 7/2001 Lewis
D445,526 S 7/2001 Wang
D446,333 S 8/2001 Frois
D447,266 S 8/2001 Verfuerth
D448,103 S 9/2001 Yuen
D449,400 S 10/2001 Tillman et al.
D449,401 S 10/2001 Tillman et al.
D449,402 S 10/2001 Echito
D450,874 S 11/2001 Heiny et al.
D451,228 S 11/2001 Poon
D452,030 S 12/2001 Collver
D452,340 S 12/2001 Pickett et al.
D452,578 S 12/2001 Yuen
D452,579 S 12/2001 Shemitz et al.
D455,516 S 4/2002 Casciani et al.
D457,981 S 5/2002 Yeh
D459,012 S 6/2002 Shemitz et al.
D459,517 S 6/2002 Shemitz et al.

(56) References Cited

U.S. PATENT DOCUMENTS

D461,923 S 8/2002 Chelf
D461,924 S 8/2002 Chelf
D462,135 S 8/2002 Chelf
D463,058 S 9/2002 Nourishad
D463,601 S 9/2002 Ludwig
D464,160 S 10/2002 Ludwig
D464,457 S 10/2002 Echito
D466,244 S 11/2002 Lewis et al.
D468,473 S 1/2003 Shemitz et al.
D470,262 S 2/2003 Yiu
D470,966 S 2/2003 Rhee
D471,308 S 3/2003 Gismondi
D472,007 S 3/2003 Weitgasser
D472,667 S 4/2003 Herst et al.
D472,668 S 4/2003 Herst et al.
D473,670 S 4/2003 Kelmelis et al.
D477,105 S 7/2003 Herst et al.
D477,891 S 7/2003 Fritze et al.
D480,830 S 10/2003 Sieczkowski
D481,149 S 10/2003 Engel
D481,483 S 10/2003 Waugh et al.
D485,635 S 1/2004 Schuetz et al.
D485,932 S 1/2004 Crane
D486,263 S 2/2004 Grothe et al.
D487,527 S 3/2004 Sieczkowski
D487,598 S 3/2004 Schuetz et al.
D491,687 S 6/2004 Thornton, Jr. et al.
D492,809 S 7/2004 Weitgasser
D493,244 S 7/2004 Engel
D493,565 S 7/2004 Smith et al.
D494,700 S 8/2004 Hartman et al.
D495,085 S 8/2004 Thornton, Jr. et al.
D496,121 S 9/2004 Santoro
D496,122 S 9/2004 Kan
D496,123 S 9/2004 Blackman
D496,486 S 9/2004 Kan
D496,745 S 9/2004 Herst et al.
D496,746 S 9/2004 Herst et al.
D496,747 S 9/2004 Herst et al.
D497,217 S 10/2004 Thornton, Jr. et al.
D498,016 S 11/2004 Herst et al.
D498,018 S 11/2004 Sieczkowski
D499,504 S 12/2004 Meyer
D500,878 S 1/2005 Lewis et al.
D500,882 S 1/2005 Herst et al.
D500,883 S 1/2005 Herst et al.
D502,565 S 3/2005 Hetfield
D504,190 S 4/2005 Keller
D505,221 S 5/2005 Hetfield
D505,744 S 5/2005 Kan
D508,582 S 8/2005 Nayler et al.
D509,616 S 9/2005 Hetfield
D511,221 S 11/2005 Zucker
D511,222 S 11/2005 Hetfield
D511,852 S 11/2005 Benensohn
D512,173 S 11/2005 Benensohn
D512,526 S 12/2005 Zucker
D512,792 S 12/2005 Pearson, Sr.
D513,439 S 1/2006 Hetfield
D513,643 S 1/2006 Vakil et al.
D514,731 S 2/2006 Engel
D517,235 S 3/2006 Vakil et al.
D519,237 S 4/2006 Kopp
D520,172 S 5/2006 Engel
D520,665 S 5/2006 Jiang
D520,666 S 5/2006 Kotovsky et al.
D520,667 S 5/2006 Jae-Sung et al.
D521,171 S 5/2006 Skegin
D521,172 S 5/2006 Chen
D521,675 S 5/2006 Chen
D522,165 S 5/2006 Hubbell et al.
7,049,761 B2 5/2006 Timmermans et al.
D523,165 S 6/2006 Schultz
D523,985 S 6/2006 Waycaster et al.
D523,986 S 6/2006 Waycaster et al.
D525,383 S 7/2006 Waycaster et al.
D525,384 S 7/2006 Waycaster et al.
D525,385 S 7/2006 Waycaster et al.
D525,738 S 7/2006 Waycaster et al.
D526,736 S 8/2006 Blackman
D530,038 S 10/2006 Kotovsky
D536,819 S 2/2007 Krahe, II
D537,553 S 2/2007 Kotovsky et al.
D543,651 S 5/2007 Hargreaves
D543,652 S 5/2007 Hargreaves
D543,653 S 5/2007 Hargreaves
D543,654 S 5/2007 Hargreaves
D544,126 S 6/2007 Stafford
D544,129 S 6/2007 Hargreaves
D544,130 S 6/2007 Hargreaves
D544,139 S 6/2007 Hargreaves
D544,626 S 6/2007 Hargreaves
D544,627 S 6/2007 Quintal
D544,628 S 6/2007 Quintal
D544,980 S 6/2007 Hargreaves
D544,981 S 6/2007 Hargreaves
D544,982 S 6/2007 Hargreaves
D544,983 S 6/2007 Hargreaves
D544,984 S 6/2007 Hargreaves
D544,985 S 6/2007 Hargreaves
D545,475 S 6/2007 Hargreaves
D545,476 S 6/2007 Friedman
D545,477 S 6/2007 DeBruyne et al.
D546,493 S 7/2007 Friedman
D547,481 S 7/2007 Tseng
D547,482 S 7/2007 Blackman
D547,897 S 7/2007 Willmorth et al.
D549,382 S 8/2007 Lee
D550,885 S 9/2007 Crosby
D551,792 S 9/2007 Philpot et al.
D553,287 S 10/2007 Miller
D554,793 S 11/2007 Bobel
D556,358 S 11/2007 Santoro
D556,359 S 11/2007 Cunius
D557,442 S 12/2007 Niemier
D558,379 S 12/2007 Citterio
D558,380 S 12/2007 Starck
D559,423 S 1/2008 Hochendoner
D561,926 S 2/2008 Salman
RE40,158 E 3/2008 Weitgasser
D564,127 S 3/2008 Cherneff et al.
D564,696 S 3/2008 Hetfield et al.
D565,234 S 3/2008 Pfund et al.
D567,425 S 4/2008 Yates
D569,026 S 5/2008 Silver
D569,027 S 5/2008 Hakamada
D570,026 S 5/2008 Waldmann
D572,400 S 7/2008 Benensohn
D573,744 S 7/2008 Engel
D573,745 S 7/2008 Engel
D573,746 S 7/2008 Engel
D574,542 S 8/2008 Engel
D575,892 S 8/2008 Chandler
D576,334 S 9/2008 Levine
D578,699 S 10/2008 Ohno et al.
D579,138 S 10/2008 Ghini
D579,139 S 10/2008 Ghini
D579,598 S 10/2008 Santoro
D580,087 S 11/2008 Couture et al.
D580,583 S 11/2008 Pfund
D581,079 S 11/2008 Mier-Langner
D581,080 S 11/2008 Mier-Langner
D583,496 S 12/2008 Kuo et al.
D584,440 S 1/2009 Allen
D584,441 S 1/2009 Ghini
D584,444 S 1/2009 Lipson
D584,844 S 1/2009 Ghini
D584,848 S 1/2009 Menke
D585,152 S 1/2009 Levine
D585,581 S 1/2009 Purcell
7,476,004 B2 * 1/2009 Chan ..... 362/240
D586,029 S 2/2009 Copeland
D586,492 S 2/2009 Copeland
D587,834 S 3/2009 Moritz

(56) References Cited

U.S. PATENT DOCUMENTS

| | | | |
|---|---|---|---|
| D588,739 | S | 3/2009 | Janssen |
| D589,199 | S | 3/2009 | Pedersen |
| D589,640 | S | 3/2009 | Janssen |
| 7,510,299 | B2 | 3/2009 | Timmermans et al. |
| D591,443 | S | 4/2009 | Beno et al. |
| D591,444 | S | 4/2009 | Beno et al. |
| D592,349 | S | 5/2009 | Maxik et al. |
| D592,785 | S | 5/2009 | Bisberg et al. |
| D592,786 | S | 5/2009 | Bisberg et al. |
| D593,246 | S | 5/2009 | Fowler, Jr. et al. |
| D593,698 | S | 6/2009 | Noh |
| D595,443 | S | 6/2009 | Tran et al. |
| D595,444 | S | 6/2009 | Shimomura |
| D595,445 | S | 6/2009 | Gunter |
| D595,447 | S | 6/2009 | Purcell |
| D595,887 | S | 7/2009 | Blom |
| D596,778 | S | 7/2009 | Yamazato |
| D597,242 | S | 7/2009 | Purcell |
| D597,701 | S | 8/2009 | Tran et al. |
| D599,051 | S | 8/2009 | Wu et al. |
| D599,945 | S | 9/2009 | Pfund |
| D602,189 | S | 10/2009 | Zambelli et al. |
| D602,625 | S | 10/2009 | Santoro |
| D602,626 | S | 10/2009 | Santoro et al. |
| D602,627 | S | 10/2009 | Lasthein et al. |
| D603,078 | S | 10/2009 | Noh |
| D603,079 | S | 10/2009 | Toot et al. |
| D603,545 | S | 11/2009 | Levine |
| D603,548 | S | 11/2009 | Pei et al. |
| D603,998 | S | 11/2009 | Fowler, Jr. et al. |
| D603,999 | S | 11/2009 | Fowler, Jr. et al. |
| D604,000 | S | 11/2009 | Fowler, Jr. et al. |
| D604,001 | S | 11/2009 | Thun |
| D604,002 | S | 11/2009 | Santoro |
| D604,446 | S | 11/2009 | Fowler, Jr. et al. |
| D604,447 | S | 11/2009 | Klaus |
| D604,884 | S | 11/2009 | Moritz |
| D604,885 | S | 11/2009 | Ford et al. |
| D605,329 | S | 12/2009 | Watt et al. |
| D605,343 | S | 12/2009 | Watt |
| D605,809 | S | 12/2009 | Noh |
| D606,229 | S | 12/2009 | Johansen et al. |
| D606,697 | S | 12/2009 | Verfuerth et al. |
| D606,698 | S | 12/2009 | Verfuerth et al. |
| D607,594 | S | 1/2010 | Waldmann |
| D607,598 | S | 1/2010 | Xiao et al. |
| D607,599 | S | 1/2010 | Zhou et al. |
| D608,042 | S | 1/2010 | Wu et al. |
| D608,043 | S | 1/2010 | Ko |
| D608,487 | S | 1/2010 | Pei et al. |
| D608,928 | S | 1/2010 | Noh |
| D608,929 | S | 1/2010 | Castelli |
| D608,930 | S | 1/2010 | Castelli |
| D608,931 | S | 1/2010 | Castelli |
| D608,932 | S | 1/2010 | Castelli |
| D608,933 | S | 1/2010 | Castelli |
| D609,385 | S | 2/2010 | Castelli |
| D609,386 | S | 2/2010 | Castelli |
| D609,841 | S | 2/2010 | Bush |
| D610,293 | S | 2/2010 | Klaus |
| D610,294 | S | 2/2010 | Theusch |
| D610,735 | S | 2/2010 | Chien |
| D610,736 | S | 2/2010 | Klaus |
| D611,182 | S | 3/2010 | Allen |
| D611,183 | S | 3/2010 | Duarte |
| D611,643 | S | 3/2010 | Owen |
| D611,645 | S | 3/2010 | Copeland |
| D612,088 | S | 3/2010 | Wassel et al. |
| D612,528 | S | 3/2010 | McGrath et al. |
| D613,897 | S | 4/2010 | Thun |
| D614,339 | S | 4/2010 | Behar et al. |
| D616,138 | S | 5/2010 | Lasthein et al. |
| D617,487 | S | 6/2010 | Fowler, Jr. et al. |
| D617,488 | S | 6/2010 | Cho |
| D617,489 | S | 6/2010 | Santoro |
| D617,935 | S | 6/2010 | Miletich et al. |
| D619,292 | S | 7/2010 | Pei et al. |
| D621,085 | S | 8/2010 | Kochanski et al. |
| D621,086 | S | 8/2010 | Purcell |
| D621,989 | S | 8/2010 | Proner |
| D624,229 | S | 9/2010 | Adolph |
| 7,815,338 | B2 * | 10/2010 | Siemiet et al. ..... 362/218 |
| 2010/0270925 | A1 * | 10/2010 | Withers ..... 315/51 |
| 2012/0306342 | A1 * | 12/2012 | Dellian et al. ..... 313/46 |

OTHER PUBLICATIONS

LED Certified LED May 2011.

* cited by examiner

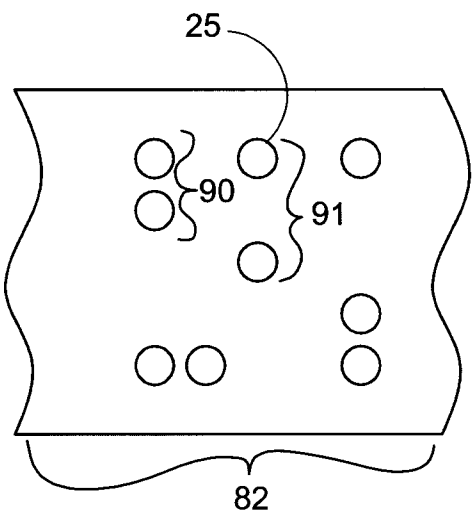
FIG.7
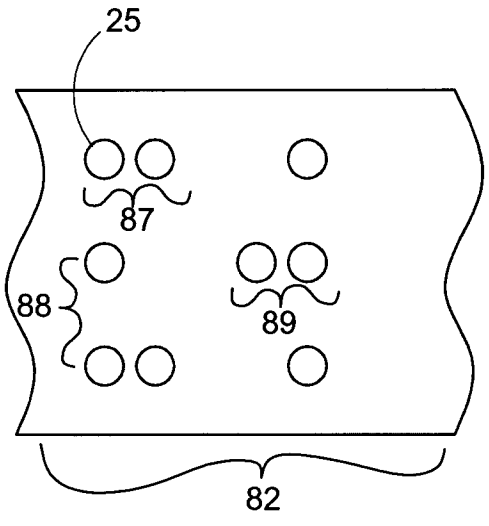
FIG.8
FIG.9

LED LIGHT TUBE AND REPLACEMENT METHOD

This is a continuation patent application based upon and claiming the priority of Ser. No. 13/164,406 filed Jun. 20, 2011, which was a regular patent application based upon provisional patent application Ser. No. 61/356,754 filed Jun. 21, 2010 and provisional patent application Ser. No. 61/471,109 filed Apr. 2, 2011, the contents of both applications incorporated herein by reference thereto.

The present invention relates to an LED light tube which replaces a fluorescent light tube and a method of replacing the fluorescent light tube which is typically mounted in a fluorescent light tube fixture.

BACKGROUND OF THE INVENTION

Fluorescent light tubes are commonly used in offices and stores and commercial buildings. These fluorescent light tubes, which may be 3, 4 or 5 feet long are removably fit into fluorescent light tube fixtures of a corresponding size. These fixtures have end mounts which cooperate with bi-pin connectors extending from the end caps of the fluorescent light tubes. Additionally, these fluorescent light tubes are powered by power conversion circuits and ballast circuits.

There is a new generation of light emitting diodes or LEDs which, in certain situations, can replace the fluorescent light tubes. U.S. Pat. No. 7,510,299 to Timmermans and U.S. Pat. No. 7,049,761 to Timmermans disclose some prior art LED light tubes.

OBJECTS OF THE INVENTION

It is an object of the present invention to provide an LED light tube for replacing a fluorescent light tube.

It is a further object of the present invention to provide an LED light tube which can reduce the power consumption for the owner or occupant of the office, warehouse or other commercial buildings.

SUMMARY OF THE INVENTION

The LED light tube is adapted to replace a fluorescent light tube which is mounted in a fluorescent light tube fixture. These fixtures have first and second socket end mounts and each end mount mechanically accepts a bi-pin connector or other standard connector (a single pin or a flat bar connector R17D, the bi-pin connector being a G13) for the fluorescent light tube. The fluorescent fixture is supplied with a main power line. In the present invention, the main power line may carry 110 to 277 volts. However, the present invention utilizes main power feed only to the first socket end mount of the fluorescent fixture and further maintains an open circuit between the main line power and the second socket end mount. The LED light tube includes an elongated tubular structure substantially the size and length of the fluorescent light tube and extends between the first and second end mounts of the fixture. Within an end region of the tubular structure and adjacent the first tube end mount, an internal power supply converts the main line power to LED bank power. The tubular structure of the LED light includes an elongated semi-spherical substantially transparent top cover mounted atop a printed circuit board substrate. The substrate supports a plurality of LEDs thereon. The transparent cover and the LED supporting substrate extends the length of the tubular structure other than the end region where the internal power supply is located. The tubular structure also includes an elongated hemispherical metal cover mounted below the printed circuit board substrate and beneath the plurality of LEDs as a heat sink for the LED replacement light. An electrical system within the tubular structure supplies the LED bank power to the plurality of LEDs on the substrate. The method of replacing the fluorescent light tube includes connecting the main line power to the first socket end mount in the fluorescent light fixture and opening an electric circuit between the main line power and the second socket end mount. The elongated tubular structure, having the size and length of the fluorescent light tube, has end caps complementary to the first and second end mounts and carries a plurality of LEDs therein. The tube has an elongated hemispherical transparent tube cover and the metal cover. An internal power supply converts the main line power to LED bank power and the method supplies the LED bank power to the LEDs on the substrate. The method also includes illuminating LEDs along the length of the elongated tubular structure except for the end region where the internal power supply is located. Heat is dissipated from the LEDs by the hollow space between the substrate and the metal cover as well as via the metal cover itself. The method includes electrically isolating the substrate from the metal cover.

BRIEF DESCRIPTION OF THE DRAWINGS

Further objects and advantages of the present invention can be found in the detailed description of the preferred embodiments when taken in conjunction with the accompanying drawings in which:

FIG. 7 diagrammatically illustrates the LED light pattern as a 3×3 sequence;

FIG. 8 diagrammatically and graphically illustrates an LED light pattern of a 3-2-1-3 sequences;

FIG. 9 diagrammatically illustrates an LED light pattern of a 3-1-2-3 sequence wherein a subgroup of LEDs are closely spaced whereas other groups of LEDs are spaced to greater distance apart (FIG. 8 also shows closely spaced LED groups);

DETAILED DESCRIPTION OF THE PREFERRED EMBODIMENTS

The present invention relates to an LED light tube which replaces a fluorescent light tube which is removably mounted in a fluorescent light tube fixture as well as a method for replacing the fluorescent light. Similar numerals designate similar items throughout the drawings.

Figure 1:
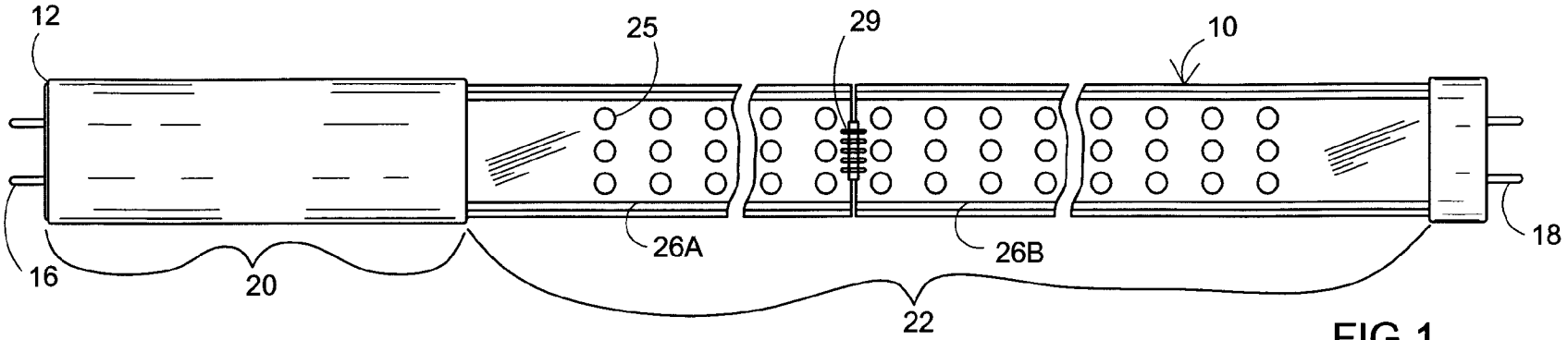
FIG. 1 diagrammatically illustrates a top view of the LED light tube without the transparent cover.
Figure 2:
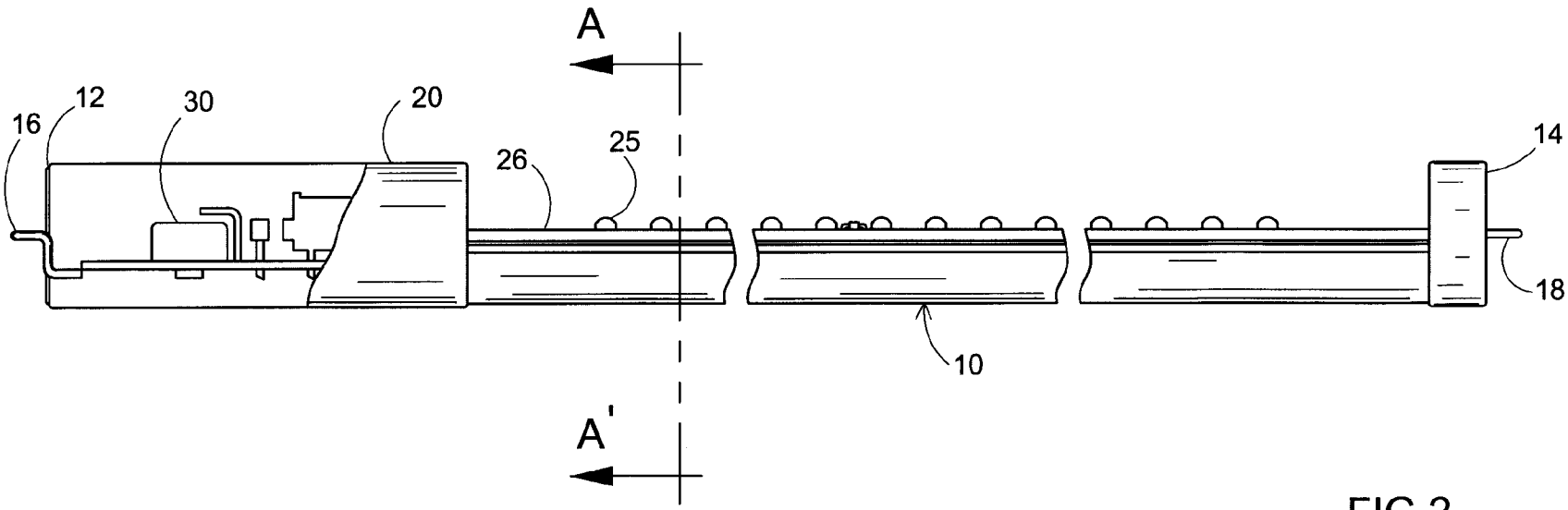
FIG. 2 diagrammatically illustrates a side view of the LED light tube and a broken way view of the internal power supply.

FIG. 1 diagrammatically illustrates LED light tube 10. FIGS. 1 and 2 are discussed concurrently herein. The length of the LED light tube is substantially similar in size to a fluorescent light tube. The LED light tube replaces the fluorescent tube. The LED light tube 10 has end cap 12 and 14 and bi-pin connectors 16, 18 protruding longitudinally from end caps 12, 14. Rather than a bi-pin connector other standard connectors (a single pin or a flat bar connector R17D, the bi-pin connector being a G13) may be used. In the illustrated embodiment, LED light tube 10 has an end region 20 and a light emitting region 22. Light emitting region 22 is filled with a plurality of LED diodes one of which is LED diode 25. It should be noted that the illustrations in FIGS. 1, 2 and 3 would be filled with LED diodes notwithstanding the fact that there are spaces on the left and right sides of those illustrations. The diodes 25 are mounted on printed circuit board 26.

FIG. 2 diagrammatically illustrates LED light tube 10 with the transparent cover removed. At end region 20, an internal power supply 30 is mounted. Internal power supply 30 is fed with main line power via pins 16 which extend from cap 12. One pin is connected to the power side and the other pin to the neutral. Main line power is 110 volts to 277 volts. In contrast, end cap 14 and pin 18 is only provided for mechanical connection to the respective end socket mount in a traditional fluorescent light fixture. Therefore, circuit board 26 carries all the power from the LED bank power generated by internal power supply 30. A connector 29 connects left printed circuit board 26A to right printed circuit board 26B.

Figure 3:
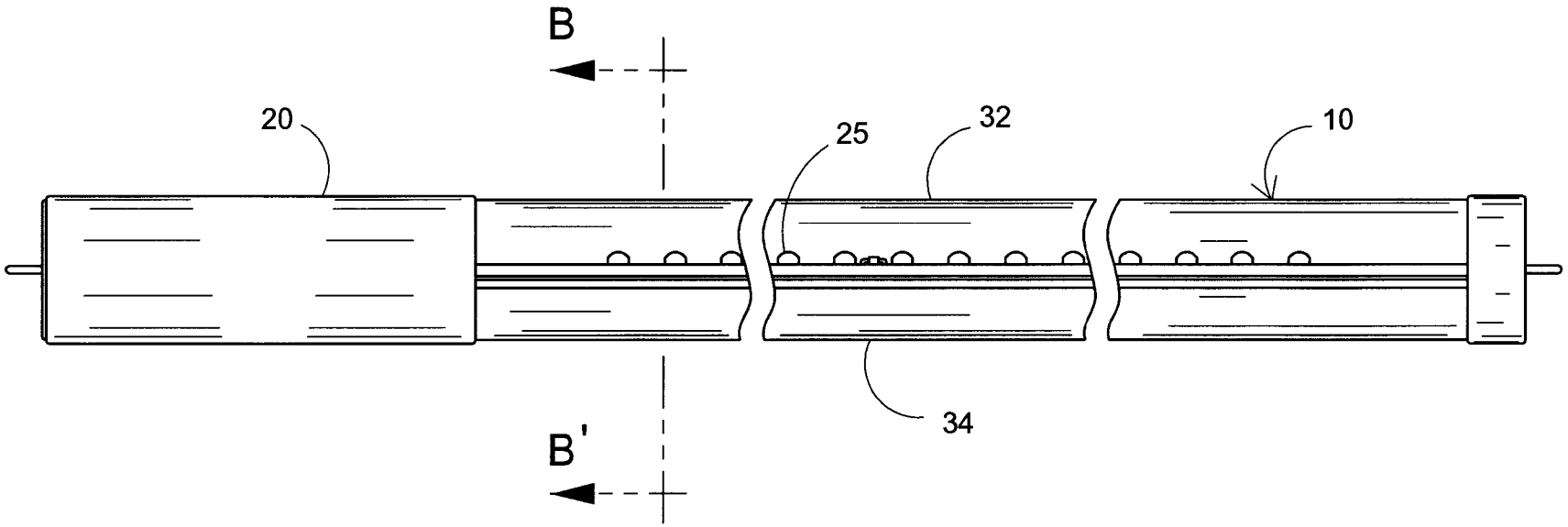
FIG. 3 diagrammatically illustrates a side view of the LED light tube showing the transparent cover.

FIG. 3 diagrammatically illustrates LED light tube 10 with a transparent elongated hemispherical top cover 32 and an elongated hemispherical bottom metal cover 34. As shown later, the transparent cover 32 locks into metal cover 34.

Figure 4:
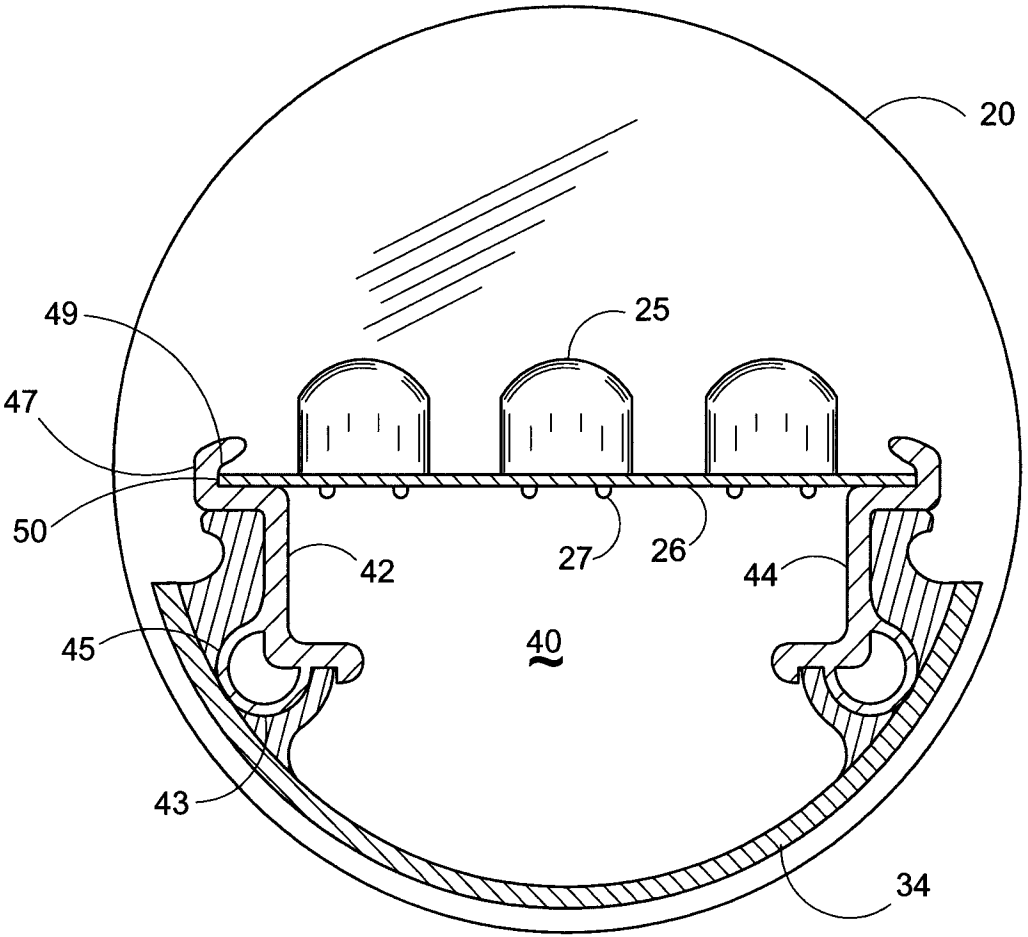
FIG. 4 diagrammatically illustrates an end view of the LED light tube from the perspective of section line A-A' in FIG. 2.

FIG. 4A diagrammatically illustrates an end view of the LED light tube from the perspective of section line A-A' in FIG. 2. LEDs 25 are mounted on printed circuit board substrate 26 and terminals 27 extend downward through printed circuit board 26 to heat sinks (shown later) and exposed to a hollow region 40 beneath the printed circuit board. The hollow region is framed by metal cover 34 and side-line insulators 42, 44. In the preferred embodiment, insulators 42, 44 are plastic and extend the length of the illuminated are 22 of LED light tube 10. However, a plurality of independent insulators could be used (longitudinally spaced) to separate and electrically isolate printed circuit board 26 from metal cover 34. Metal cover 34 is mounted beneath the printed circuit board 26. As shown in FIG. 4, insulator 42 has a arcuate protruding loop 43 which is complementary to arcuate cavity 45 formed in metal cover 34. Additionally, the upper end 47 of insulator 42 includes opposing C-shaped channels one of which is C-shaped channel 49 which cooperates and locks edge 50 of printed circuit board 26 therein. The channels may be C or U or square shaped. Insulator 44 includes the same arcuate locking element 43 which cooperates with open arc channel 45 on the right hand side of the LED light system shown in FIG. 4.

In a preferred embodiment, printed circuit board substrate 26 is disposed or mounted substantially along the axial center line of the tubular structure that forms LED light tube 10. As stated earlier, end caps 12, 14 and associated pins 16, 18 connect mechanically and complementary to the corresponding socket end mounts of a conventional fluorescent light fixture. However, only end cap 12 and more particularly bi-pins 16 are electrically coupled to the main power line or main line power at the corresponding fixture socket end.

Figure 5:
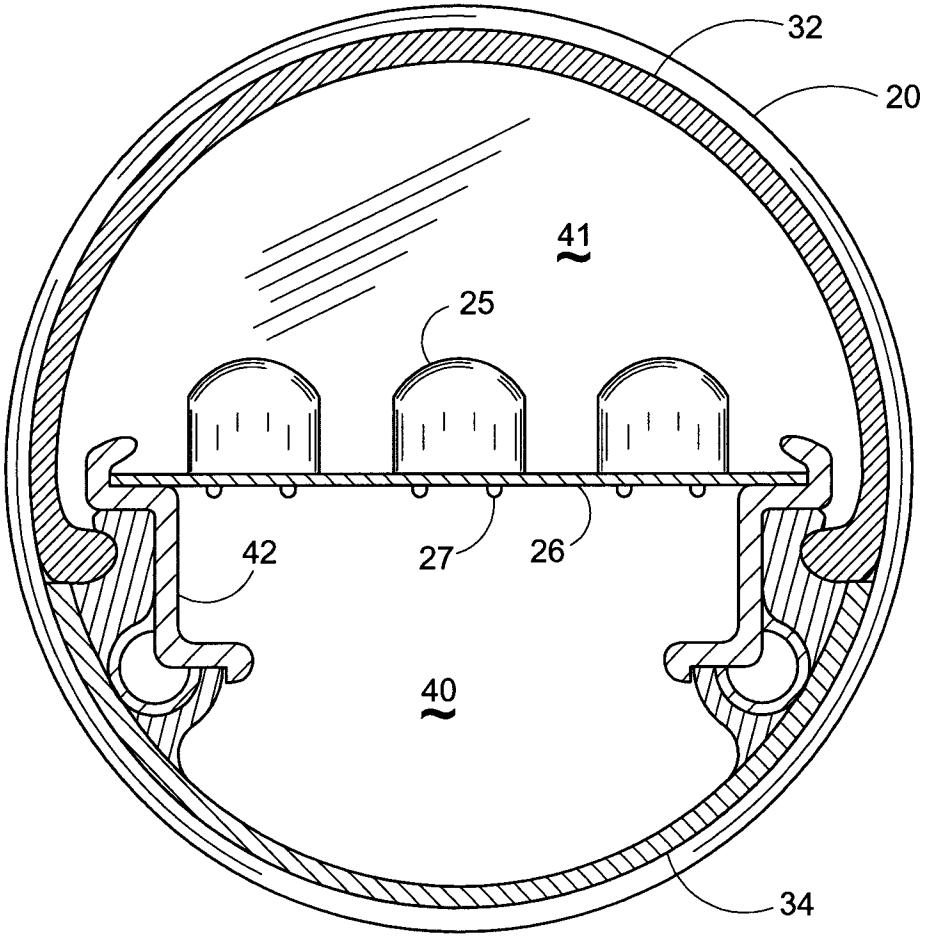
FIG. 5 diagrammatically illustrates an end view of the LED light tube from the perspective of section line B-B' in FIG. 3.

The present construction establishes the hollow space 40 beneath the printed circuit board 26 provides LEDs 25 a heat sink volume and metal cover 34 draws heat from that hollow volume space away from the LEDs. The LEDs have very hot transistor junctions and the heat from hot transistor junctions must be drawn away from the circuit board 26 and from the entire interior hollow space. As shown in FIG. 5, the interior space also includes an upper elongated cavity 41 above LEDs 25. Therefore, the circuit board substrate 26 is thermally adjacent the metal cover 34. Being thermally adjacent means that the heat generated from the transistor hot junctions is drawn away from the board surface. A substantial portion of this heat is generated from beneath printed circuit board 26.

Figure 6A:
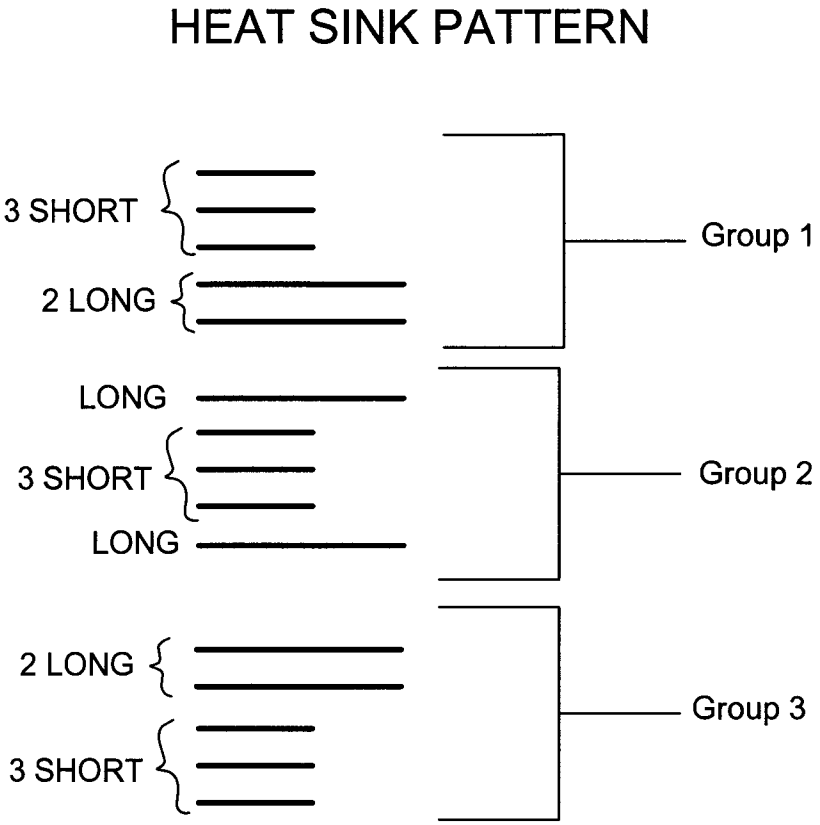
FIG. 6A diagrammatically and graphically illustrates the heat sink pattern on the lower surface of the printed circuit board.
Figure 6B:
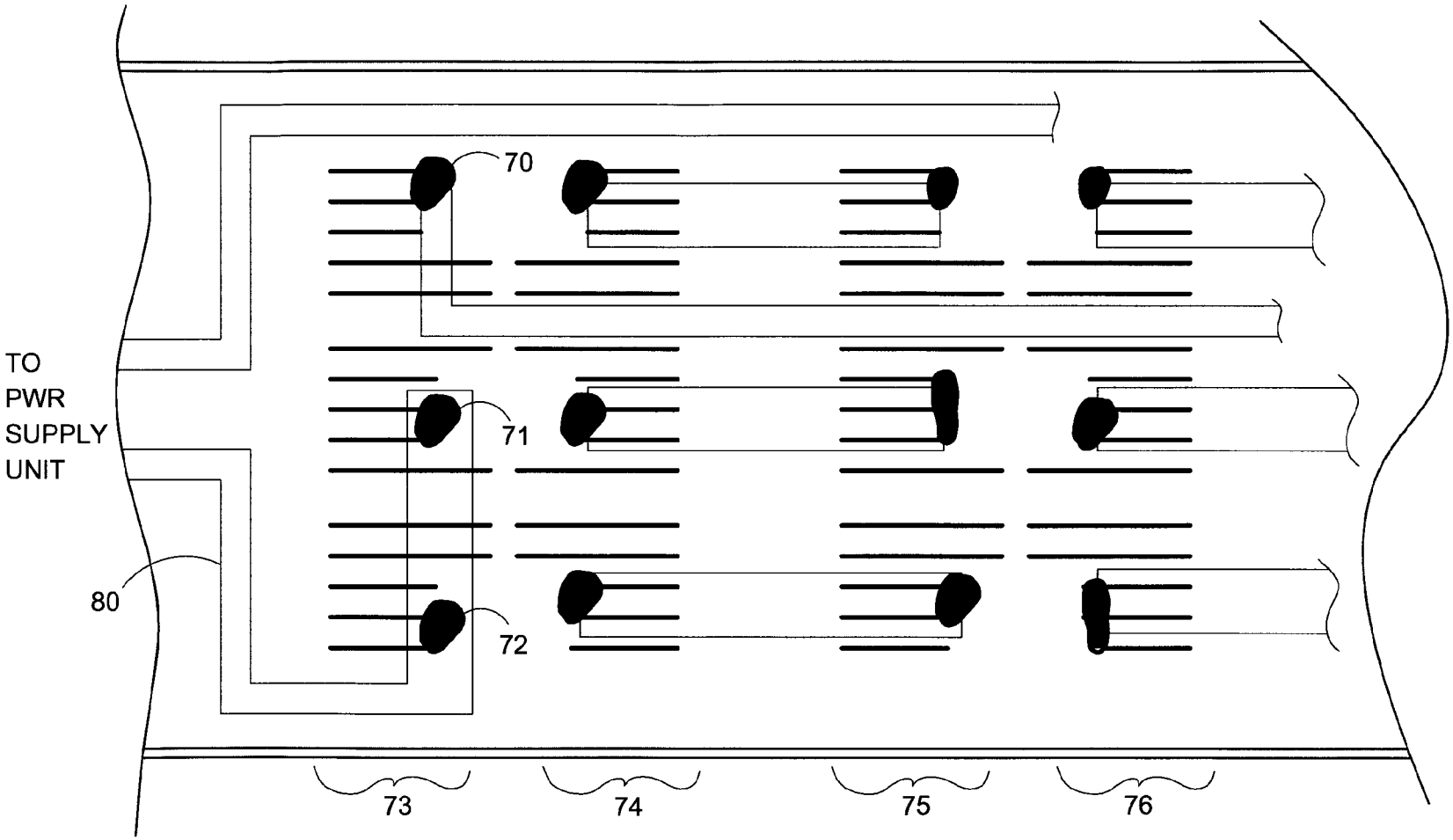
FIG. 6B diagrammatically illustrates the heat sink pattern for a set LEDs as well as circuit conductive tracks on the printed circuit board.

FIG. 6A shows a heat sink pattern on the lower face of the board with three groups of heat sinks, group 1, group 2 and group 3. FIG. 6B shows that LED terminal 70 is crudely soldered or connected to the short elements of group 1. LED solder terminal 71 is crudely thermally and metallically attached (soldered) to short elements of group 2 and LED terminal solder point 72 is crudely attached to group 3 heat sink patterns.

These heat sink patterns and the variations between group 1, group 2 and group 3 accomplish several objectives. First, the solder point beneath the LED terminal 27 (see solder points 70, 71 and 72) can vary from LED terminal to LED terminal. Multiple heat sinks are provided in order to spread the heat generated by the transistor junctions away horn the board itself. The junction is immediately on top or near the top of the printed circuit board and therefore the heat is carried away by the terminal of the LED but also from the printed circuit board itself. Lateral series 73 and FIG. 6B differs from lateral series 74 in that series 74 is a mirror of series 73. Lateral series 75 repeats heat sink pattern at series 73 and series 76 is a repeat of the pattern 74. Graphically illustrated in FIG. 6B is an electrical connection pattern 80. However, electric connection patterns can differ as known to persons of ordinary skill of the art.

FIGS. 7, 8 and 9 diagrammatically illustrate spacing of LEDs 25 over region 82 on printed circuit board 26. In other words, the longitudinal space 82 covers the same length in FIGS. 7, 8 and 9. In FIG. 7 a 3×3 grid of LEDs 25 is shown. Each of the LEDs is spaced a substantially equal distance apart such that space 84 is substantially equal to space 86. In FIG. 8, a 3-2-1-3 pattern is identified wherein the numeric series refers to the number of lights in a lateral row as the observer views longitudinal space 82 from left to right. Therefore, on the left of space 82 in FIG. 8, three LEDs 25 are positioned, and immediately adjacent thereto in a closely space arrangement are two LEDs. This is a 3-2 sequence. The distance 87 is closely spaced such that the LEDs in the space 87 cannot accommodate or fit another LED light. However, space 88 in the series 3 left lateral series is spaced a greater distance apart than close spacing 87. Close spacing is also noted at region 89. In FIG. 9, a 3-1-2-3 lateral spacing is shown for LEDs 25. Space 90 is a close spacing wherein another LED light could not be added or inserted between space 90. In contrast, space 91 is a greater space apart and an additional LED could be inserted in that greater space item.

Figure 13:
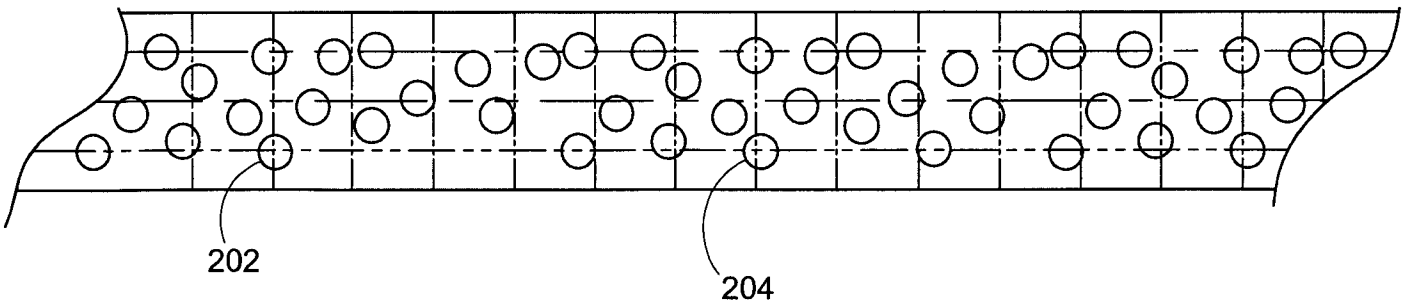
FIG. 13 shows a repeating 18 LED position pattern.

FIG. 13 shows a 18 LED repeating pattern from LED 202 to LED 204. The spacing between LEDs in this 18 light repeating pattern varies within the pattern as shown.

Figure 10A:
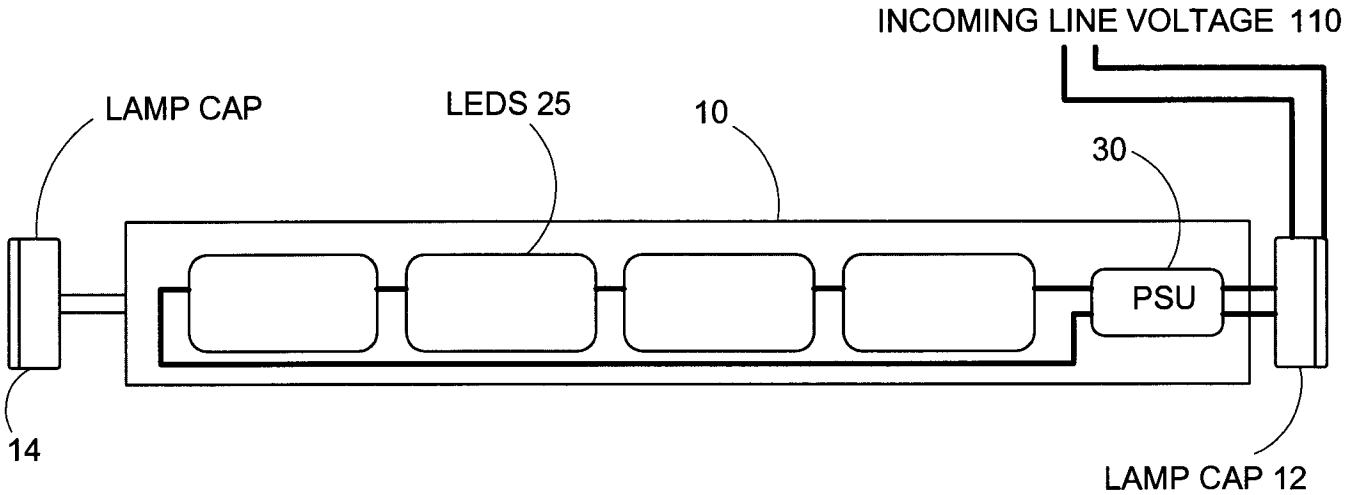
FIG. 10A diagrammatically illustrates the main line power fed to one socket end mount and a diagram of the LED light tube.

FIG. 10A diagrammatically shows that internal power supply unit 30 is fed with incoming line voltage 110 via electrically active end cap 12. Electrically opened or unconnected end cap 14 is not connected to the main line power.

Figure 10B:
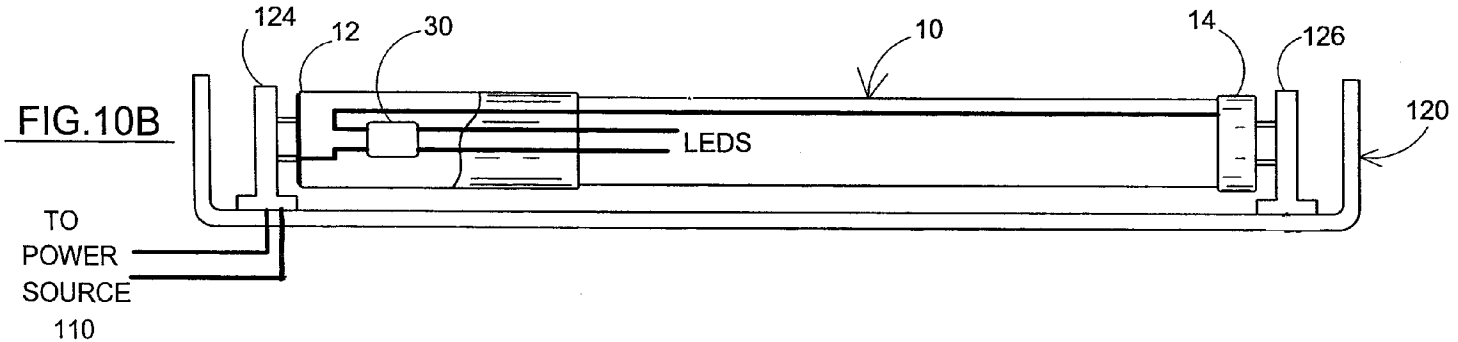
FIG. 10B diagrammatically illustrates a side view of the one end power feed system.

FIG. 10B diagrammatically shows LED light tube 10 mounted in fluorescent light tube fixture 120. End cap 12 of LED light tube 10 is mechanically and electrically coupled to socket end mount 124 of fixture 120. Main line power 110 is fed into socket end mount 124 and internal power supply 30 converts the power to an LED bank power which is fed to the LEDs inside LED light tube 10. Socket end mount 126 is not connected to power source 110 and there is an open electrical connection between power source 110 and socket end mount 126 of the fluorescent fixture 120.

Figure 11:
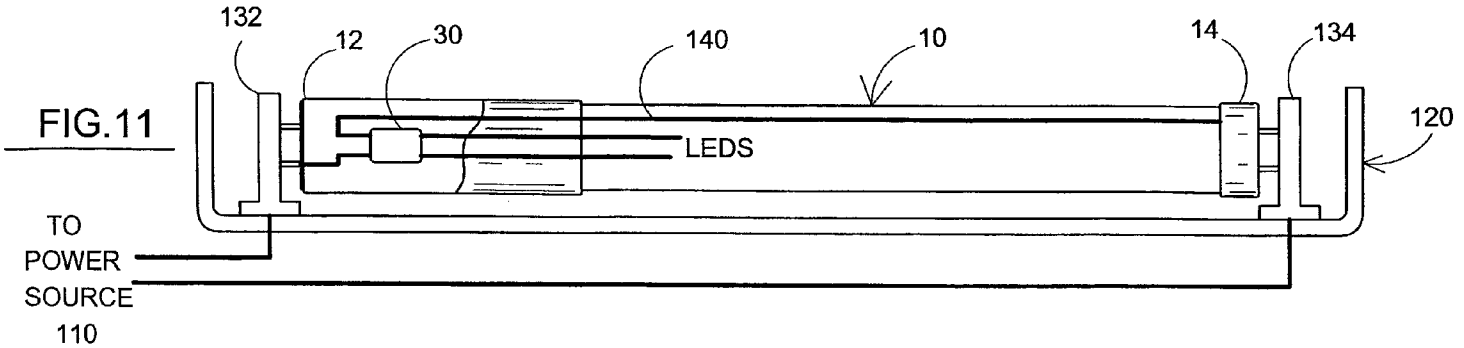
FIG. 11 diagrammatically illustrates power fed to both the first socket end mount and the second socket end mount and a diagram of the LED light tube.

FIG. 11 diagrammatically shows that socket end mount 132 is fed power from main line power source 110 but the neutral line from power source 110 is electrically connected to socket end mount 34. Socket end mounts 132, 134 are common in fluorescent fixture 120. The LED light tube 10 includes therein, inside the tube, an electrical line 140 which brings the neutral from end cap 14 and socket end mount 134 to power supply unit 30. From power supply unit 30, the bank of LED is powered.

Figure 12:
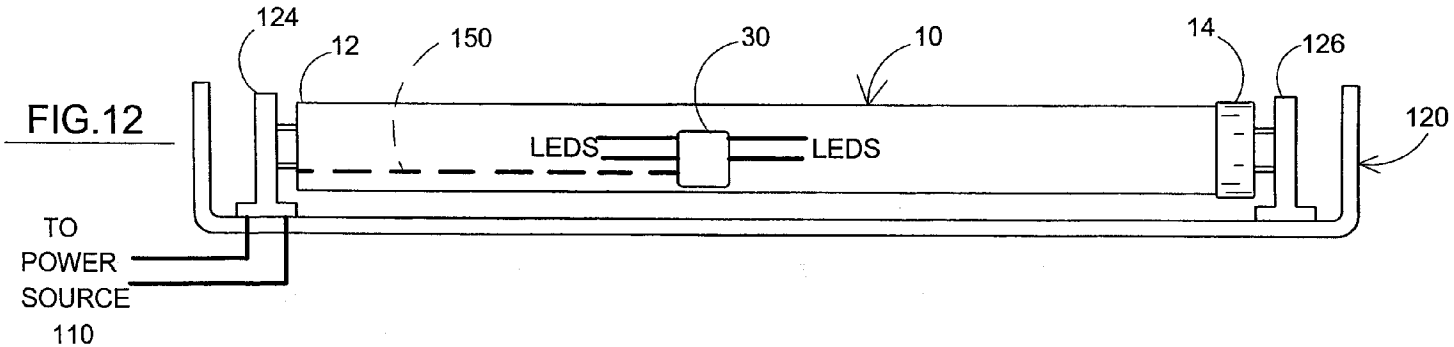
FIG. 12 diagrammatically illustrates an LED light tube with an internal power supply mounted at intermediate location and the main line power fed to a single socket end mount.

FIG. 12 diagrammatically illustrates a configuration wherein the internal power supply 30 is mounted intermediate end cap 12 and end cap 14 of LED light tube 10. In this situation, main line power 110 is fed via socket end mount 124 to the bi-pins in the adjacent end cap and both the power and the neutral is provided by electrical connectors 150 to internal power supply unit 30. Left side bank of LEDs is supplied with power from power supply unit 30 and right side bank of LEDs is powered from supply 30. Rather than a bi-pin connector, other standard connectors (a single pin or a flat bar connector R17D, the bi-pin connector being a G13) may be used.

In a preferred embodiment, end region 20 has an opaque cover over it.

The replacement operation utilizes the LED light tube described earlier. The fluorescent light tube fixture has first and second socket end mounts 124, 126 and each end mount mechanically accepts the bi-pin connector extending longitudinally from end cap 12, 14 of LED light tube 10. Each end mount 124, 126 mechanically accepts the bi-pin connector from LED light tube 10. However, the fluorescent light tube fixture is supplied with main light power only from one socket end mount 124. The power and neutral wire from the main line power is applied to socket end mount 124 in the fluorescent light fixture 120. The replacement operation opens the electric circuit between the main power line and the second socket end mount 126. The LED located on the printed circuit board substrate is supplied with LED bank power from the power supply 30. The LED light tube illuminates the length 22 of the tubular structure 10 except for end region 20. Heat is dissipated from the LEDs by way of the hollow space 40 between the printed circuit board substrate and the metal cover 34 and is also dissipated to the ambient environment by metal cover 34. Printed circuit board 26 is electrically isolated from metal cover 34 by one or more insulators 42, 44.

The following table provides information regarding the current working embodiment for the LED light tube.

| T8 Replacement LED Tubes | |
|---|---|
| Wattage total | 15 |
| Lumens emitted | 1368 |
| Lumens/W | 91 |

-continued

| T8 Replacement LED Tubes | |
|---|---|
| Lumens/VA | 85 (above 80) |
| Voltage range | 120 V-277 V |
| Power Factor (See page 5) | >0.9 |
| Junction temp spec 90° C. | amb + 10° C. |
| Amperes | .06-.14 |
| Diode Power feed | Constant Current |
| ETL or UL listing | Class 2 |
| CRI (color accuracy) | 80 |
| Color Chromaticity | White |
| Retrofits in existing fixtures | Yes |
| Binned diodes | Yes |
| Load Free solder | Yes |
| Gallium Arsenide | NO |
| Through Hole LED 4.8 mm diameter check | |
| Constant current feed | |
| Power supply | 120-240 V AC |
| 254 LED units | |
| 4 foot long tube | |
| Power supply length | 1 to 4 inches |

Currently, the LEDs used in one embodiment of the invention are 20 mA; 2.8V-3.6V LEDs and 252 LEDs are used in the array. This number of LEDs, that is, less than 280 LEDs, permits the power supply unit 30 to be solely encased in one end 20 of the tube. A class 2 power supply is used, 120-277V at 0.061-0.14 A and at 15 W with a p.f. 0.9. The power supply complies with UL 1310. The LED drivers are 94V-0V operating at a minimum 130° C. CTI=3 and the size is 75.5 mm×25 mm×1.6 mm.

The tube is 1112 mm long and about 30 mm in diameter. The form fitting power supply at end 20 is sized to be less than 30 mm wide (to fit into a 32 mm casing (slightly larger than the tube, but substantially the same size). The class 2 power supply converts 120-277 v AC (50-60 Hz; 0.061-0.14 A) to 15 w, 31 v DC which is the LED drive voltage. The transformer in the power supply, one of the largest components is no more than 25 mm wide (preferably 21 mm wide) and 22 mm long (preferably 20 mm) and from bottom end plate to top, no higher than 20 mm (preferably 17 mm). The transformer construction is N1, 16 turns, N2 96 turns, N3 14 turns, N4 12 turns and N5 26 turns (N5 being the high side). Electrical characteristics are inductance at 50 Hz, 1 v is L2−1=1, 18 mH+/−10%; Lk2−1=35, 5 mohos max; primary to secondary 3000 vac at 3 mA and 2 S; primary to core is 1000 vac at 3 ma and 2 S and secondary to sore is 1000 vac at 3 ma at 2 S.

With the placement of the entire power supply inside one end of the tube, this feature (a) reduces the probability of electric shock to the user and installer; (b) permits thermal characteristics and heat transfer to and from the LED PC board bar element and the end placement does not interfere with the heat transfer characteristics of the LEDS over the length of the tube, that is, LED to LED, (other prior art power supplies being mounted beneath the LED PC board, resulting in a different or disrupted thermal pattern over the length of the LED PC board, and hence a disruption of the thermal transfer characteristics of the entire system); and (c) the end placement of the power supply assures that the light output of the entire system is uniform rather than being disrupted by an mid-sectional placement of the power supply. The use of less than 280 LEDs assures that the power supply can be fit into the end segment. Also, the characteristics of the transformer match the LED count thereby achieving the beneficial aspects described earlier.

The claims appended hereto are meant to cover modifications and changes within the scope and spirit of the present invention.

What is claimed is:

1. An LED light tube for replacing a fluorescent light tube mounted in a fluorescent light tube fixture, said fluorescent light tube fixture having first and second socket end mounts, each end mount mechanically accepting a common fixture connector for said fluorescent light tube, said fluorescent light tube fixture being supplied with main line power, said main line power being 110 volts to 277 volts, comprising:

a power and a neutral wire connection from said main line power to the first socket end mount in the light fixture and an open circuit between said main line power and the second socket end mount;

an elongated tubular structure substantially the size and length of said fluorescent light tube and extending between said first and second end mounts;

within an end region of said tubular structure and adjacent said first socket end mount, an internal power supply for converting said main line power to LED bank power, said internal power supply electrically coupled to said main line power via said first socket end mount;

said internal power supply being a form fitting, Class 2 power supply with a transformer no larger than 25×22×22 mm in size, the Class 2 power supply converts 120-277 v AC (50-60 Hz; 0.061-0.14 A) to 15 w, 31 v DC which is the LED drive voltage for no more than 280 LEDs;

said tubular structure including:

an elongated hemispherical substantially transparent tube cover mounted atop a printed circuit board substrate, said substrate supporting a plurality of no more than 280 LEDs, said tube cover and LED supporting substrate extending the length of said tubular structure other than said at said end region;

an elongated hemispherical metal cover mounted below the printed circuit board substrate and beneath said plurality of LEDs as a heat sink; and an electrical system within said tubular structure suppling said LED bank power to said plurality of LEDs on said substrate.

2. An LED light tube as claimed in claim 1 wherein said substrate disposed substantially along an axial center line of said tubular structure.

3. An LED light tube as claimed in claim 1 said tubular structure has first and second end caps which are mechanically complementary to said first and second socket end mounts, said first end cap electrically coupled to said main line power at said first socket end and said second end cap not electrically coupled to said main line power at said second socket end.

4. An LED light tube as claimed in claim 1 wherein each LED of said plurality of LEDS has a pair of terminals, and the LED light tube includes a group of heat sink strips beneath each terminal for each LED, each group of heat sink strips being a local heat sink for the respective LED terminal.

5. An LED light tube as claimed in claim 4 wherein said heat sink strips are beneath the circuit board substrate and are thermally adjacent said metal cover and said plurality of LEDS mounted on a topside of said substrate.

6. An LED light tube as claimed in claim 1 wherein at least 250 LEDs are supported on said substrate.

7. An LED light tube as claimed in claim 1 including an opaque end region cover over said power supply.

8. An LED light tube as claimed in claim 1 wherein said LEDs are not uniformly spaced apart on said substrate.

9. An LED light tube as claimed in claim 8 wherein a first sub-plurality of said plurality of LEDs are closely spaced together and a second sub-plurality of said plurality of LEDs are spaced a greater distance apart.

10. An LED light tube as claimed in claim 1 wherein said metal cover is electrically isolated from said printed circuit board substrate by one or more insulators.

11. An LED light tube as claimed in claim 1 wherein said metal cover is electrically isolated from said printed circuit board substrate by an elongated insulator substantially extending the length of said tubular structure.

12. An LED light tube as claimed in claim 1 wherein said metal cover is electrically isolated from said printed circuit board substrate by a pair of elongated insulators substantially extending the length of said tubular structure between said printed circuit board substrate and said metal cover.

13. An LED light tube as claimed in claim 1 wherein said transparent cover is exposed the ambient environment and said metal cover is exposed the ambient environment to respectively transmit light from the LEDs and to transmit heat from the LEDs.

14. An LED light tube adapted to replace a fluorescent light tube mounted in a fluorescent light tube fixture, said fluorescent light tube fixture having first and second socket end mounts, each end mount mechanically accepting a common fixture connector for said fluorescent light tube, said fluorescent light tube fixture being supplied with main line power, said main line power being 110 volts to 277 volts and being fed to the first socket end mount in the light fixture with an open circuit between said main line power and the second socket end mount, the LED light tube comprising:

an elongated tubular structure substantially the size and length of said fluorescent light tube and extending between said first and second end mounts;

within an end region of said tubular structure and adjacent said first socket end mount, an internal power supply for converting said main line power to LED bank power, said internal power supply electrically coupled to said main line power via said first socket end mount;

said internal power supply being a form fitting, Class 2 power supply with a transformer no larger than 25×22×22 mm in size, the Class 2 power supply converts 120-277 v AC (50-60 Hz; 0.061-0.14 A) to 15 w, 31 v DC which is the LED drive voltage for no more than 280 LEDs;

said tubular structure including:

an elongated hemispherical substantially transparent tube cover mounted atop a printed circuit board substrate, said substrate supporting a plurality of no more than 280 LEDs, said tube cover and LED supporting substrate extending the length of said tubular structure other than said at said end region;

an elongated hemispherical metal cover mounted below the printed circuit board substrate and beneath said plurality of LEDs as a heat sink; and an electrical system within said tubular structure suppling said LED bank power to said plurality of LEDs on said substrate.

15. An LED light tube as claimed in claim 14 wherein said substrate disposed substantially along an axial center line of said tubular structure, and said tubular structure has first and second end caps which are mechanically complementary to said first and second socket end mounts, said first end cap electrically coupled to said main line power at said first socket end.

16. An LED light tube as claimed in claim 14 wherein each LED of said plurality of LEDS has a pair of terminals, and the LED light tube includes a group of heat sink strips beneath each terminal for each LED, each group of heat sink strips being a local heat sink for the respective LED terminal and wherein said heat sink strips are beneath the circuit board substrate and are thermally adjacent said metal cover.

17. An LED light tube as claimed in claim 14 including an opaque end region cover over said power supply.

18. An LED light tube as claimed in claim 14 wherein said LEDs are not uniformly spaced apart on said substrate and wherein a first sub-plurality of said plurality of LEDs are closely spaced together and a second sub-plurality of said plurality of LEDs are spaced a greater distance apart.

19. An LED light tube as claimed in claim 14 wherein said metal cover is electrically isolated from said printed circuit board substrate by one or more insulators.

20. An LED light tube as claimed in claim 1 wherein said metal cover is electrically isolated from said printed circuit board substrate by either a singular elongated insulator substantially extending the length of said tubular structure or by a pair of elongated insulators substantially extending the length of said tubular structure between said printed circuit board substrate and said metal cover, and said transparent cover is exposed the ambient environment and said metal cover is exposed the ambient environment to respectively transmit light from the LEDs and to transmit heat from the LEDs.

21. An LED light tube adapted to replace a fluorescent light tube mounted in a fluorescent light tube fixture, said fluorescent light tube fixture having first and second socket end mounts, each end mount mechanically accepting a common fixture connector for said fluorescent light tube, said fluorescent light tube fixture being supplied with main line power, said main line power being 110 volts to 277 volts and being fed to the first socket end mount in the light fixture with an open circuit between said main line power and the second socket end mount, the LED light tube comprising:

an elongated tubular structure substantially the size and length of said fluorescent light tube and extending between said first and second end mounts;

within a defined region of said tubular structure and electrically connected to said first socket end mount, an internal power supply for converting said main line power to LED bank power, said internal power supply electrically coupled to said main line power via said first socket end mount, said defined region being intermediate said first and second end mounts;

said internal power supply being a form fitting, Class 2 power supply with a transformer no larger than 25×22×22 mm in size, the Class 2 power supply converts 120-277 v AC (50-60 Hz; 0.061-0.14 A) to 15 w, 31 v DC which is the LED drive voltage for no more than 280 LEDs;

said tubular structure including:

an elongated hemispherical substantially transparent tube cover mounted atop a printed circuit board substrate, said substrate supporting a plurality of no more than 280 LEDs, said tube cover and LED supporting substrate extending the length of said tubular structure other than said at said defined region;

an elongated substantially metal cover mounted below the printed circuit board substrate and beneath said plurality of LEDs as a heat sink;

an electrical system within said tubular structure suppling said LED bank power to said plurality of LEDs on said substrate; and said internal power supply mounted on said printed circuit board substrate.

22. An LED light tube as claimed in claim 21 wherein said substrate disposed substantially along an axial center line of said tubular structure, and said tubular structure has first and second end caps which are mechanically complementary to said first and second socket end mounts, said first end cap electrically coupled to said main line power at said first socket end.

23. An LED light tube as claimed in claim 21 wherein each LED of said plurality of LEDS has a pair of terminals, and the LED light tube includes a group of heat sink strips beneath each terminal for each LED, each group of heat sink strips being a local heat sink for the respective LED terminal and wherein said heat sink strips are beneath the circuit board substrate and are thermally adjacent said metal cover.

24. An LED light tube as claimed in claim 21 including an opaque end region cover over said power supply.

25. An LED light tube as claimed in claim 21 wherein said LEDs are not uniformly spaced apart on said substrate and wherein a first sub-plurality of said plurality of LEDs are closely spaced together and a second sub-plurality of said plurality of LEDs are spaced a greater distance apart.

26. An LED light tube as claimed in claim 21 wherein said metal cover is electrically isolated from said printed circuit board substrate by one of:

a plurality of insulators;

a singular elongated insulator substantially extending the length of said tubular structure; or a pair of elongated insulators substantially extending the length of said tubular structure between said printed circuit board substrate and said metal cover; and wherein said transparent cover is exposed the ambient environment and said metal cover is exposed the ambient environment to respectively transmit light from the LEDs and to transmit heat from the LEDs.

27. A method of replacing a fluorescent light tube with an LED light tube adapted to be mounted in a fluorescent light tube fixture, said fluorescent light tube fixture having first and second socket end mounts, each end mount mechanically accepting a common fixture connector for said fluorescent light tube, said fluorescent light tube fixture being supplied with main line power, said main line power being 110 volts to 277 volts, comprising:

connecting a power and a neutral wire from said main line power to the first socket end mount in the light fixture;

opening the electric circuit between said main line power and the second socket end mount;

providing an elongated tubular structure substantially the size and length of said fluorescent light tube with end caps complementary to said first and second end mounts, said tubular structure having an end region adjacent said first socket end mount, an internal power supply for converting said main line power to LED bank power, an elongated hemispherical substantially transparent tube cover mounted atop a printed circuit board substrate, a plurality of no more than 280 LEDs on the substrate and extending the length of said tubular structure other than said at said end region, and an elongated hemispherical metal cover mounted below the printed circuit board substrate and beneath said plurality of LEDs as a heat sink;

said internal power supply being a form fitting, Class 2 power supply with a transformer no larger than 25×22×22 mm in size, the Class 2 power supply converts 120-277 v AC (50-60 Hz; 0.061-0.14 A) to 15 w, 31 v DC which is the LED drive voltage for no more than 280 LEDs;

suppling said LED bank power to said plurality of LEDs on a said substrate;

illuminating the length of said elongated tubular structure except for said end region;

dissipating heat generated from said LEDs via (a) the hollow space between said substrate and said metal cover and (b) the metal cover; and electrically isolating said substrate from said metal cover.

* * * * *